US008330340B2

(12) United States Patent
Higashikawa et al.

(10) Patent No.: US 8,330,340 B2
(45) Date of Patent: Dec. 11, 2012

(54) LIGHT EMITTING DEVICE, PLASMA DISPLAY PANEL, AND PLASMA DISPLAY DEVICE

(75) Inventors: Masahiro Higashikawa, Osaka (JP); Izumi Toyoda, Osaka (JP); Kenji Hasegawa, Osaka (JP)

(73) Assignee: Panasonic Corporation, Osaka (JP)

( * ) Notice: Subject to any disclaimer, the term of this patent is extended or adjusted under 35 U.S.C. 154(b) by 63 days.

(21) Appl. No.: 12/866,170

(22) PCT Filed: Jan. 29, 2009

(86) PCT No.: PCT/JP2009/000343

§ 371 (c)(1),
(2), (4) Date: Aug. 4, 2010

(87) PCT Pub. No.: WO2009/098852

PCT Pub. Date: Aug. 13, 2009

(65) Prior Publication Data

US 2011/0043106 A1 Feb. 24, 2011

(30) Foreign Application Priority Data

Feb. 8, 2008 (JP) ..... 2008-028821

(51) Int. Cl.

| | |
|---|---|
| ***H01J 5/16*** | (2006.01) |
| ***H01J 61/40*** | (2006.01) |
| ***H01K 1/26*** | (2006.01) |
| ***H01K 1/30*** | (2006.01) |

(52) U.S. Cl. ..... 313/113; 313/498; 313/506; 313/582; 313/634

(58) Field of Classification Search ..... 313/113, 313/498, 506, 582, 584, 634, 635
See application file for complete search history.

(56) References Cited

U.S. PATENT DOCUMENTS

| | | | | |
|---|---|---|---|---|
| 5,939,826 | A * | 8/1999 | Ohsawa et al. | 313/582 |
| 6,611,099 | B1 * | 8/2003 | Murata et al. | 313/582 |
| 6,888,310 | B2 | 5/2005 | Tadaki et al. | |
| 2001/0054871 | A1 * | 12/2001 | Tadaki et al. | 313/586 |

FOREIGN PATENT DOCUMENTS

| | | |
|---|---|---|
| JP | 2002-334659 | 11/2002 |
| WO | 00/19479 | 4/2000 |

* cited by examiner

*Primary Examiner* — Anh Mai
*Assistant Examiner* — Kevin Quarterman
(74) *Attorney, Agent, or Firm* — Hamre, Schumann, Mueller & Larson, P.C.

(57) ABSTRACT

The light emitting device according to the present invention includes: a substrate (11); a light emitting layer (13) provided on the substrate (11); and a reflective layer (12) provided between the substrate (11) and the light emitting layer (13). The reflective layer (12) includes plate-like inorganic oxide particles. The inorganic oxide particles are accumulated on the substrate (11) in such a way that the largest face of each of the inorganic oxide particles is oriented substantially parallel to the principal plane of the substrate (11).

15 Claims, 8 Drawing Sheets

LIGHT EMITTING DEVICE, PLASMA DISPLAY PANEL, AND PLASMA DISPLAY DEVICE

TECHNICAL FIELD

The present invention relates to light emitting devices, plasma display panels, and plasma display devices.

BACKGROUND ART

Plasma display devices with plasma display panels (hereinafter may be referred to as PDP) allow high resolution and large screen to be realized. The plasma display devices are therefore used in 50-100 inches or more full high definition televisions and large size display devices for public viewing.

In recent years, researches have been made in order to increase brightness of the PDPs.

For example, JP2002-334659A discloses a PDP in which reflective glass beads are disposed below phosphor layers. This structure allows light emitted backward from phosphors to be reflected forward, thereby increasing brightness of the PDP.

SUMMARY OF INVENTION

However, the present inventors found that the structure disclosed in JP2002-334659A has a problem in that it does not allow light emitted from the phosphors to be reflected forward sufficiently. In the structure disclosed in JP2002-334659A, spherical glass beads are used as the reflective material. Because of this, light emitted from the phosphors passes through the space between the glass beads and is reflected diffusely in the reflective layer, so that the light reaches barrier ribs in the back side or the back substrate and is absorbed thereby.

The present invention has been accomplished in view of the above problems. The object of the present invention is to provide a light emitting device, a plasma display panel, and a plasma display device with high brightness.

The present invention provides a light emitting device including: a substrate; a light emitting layer provided on the substrate; and a reflective layer provided between the substrate and the light emitting layer, wherein the reflective layer includes plate-like inorganic oxide particles.

The present invention further provides a plasma display panel including: a substrate having a principal plane in which a plurality of concave portions are formed; a phosphor layer provided within the concave portions; and a reflective layer provided between the phosphor layer and inner surfaces of the concave portions, wherein the reflective layer includes plate-like inorganic oxide particles.

The present invention further provides a plasma display device including the above-mentioned plasma display panel according to the present invention.

The present invention can provide a light emitting device, a plasma display panel, and a plasma display device with high brightness.

BEST MODE FOR CARRYING OUT THE INVENTION

Hereinafter, embodiments of the present invention will be described with reference to the drawings. The following embodiments are examples of the present invention, and the present invention is not limited thereto. In the descriptions of the following embodiments, the same numerals will be used for the same members, and repeated explanations thereof will be omitted in some cases.

Embodiment 1

Figure 1:
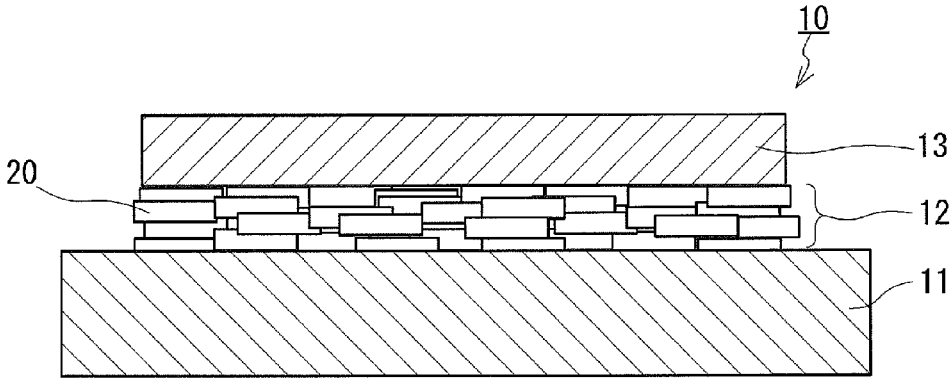
FIG. 1 is a cross-sectional view showing a schematic configuration of a light emitting device of Embodiment 1 according to the present invention.

FIG. 1 is a cross-sectional view showing a schematic configuration of a light emitting device 10 of Embodiment 1 according to the present invention.

The light emitting device 10 includes a substrate 11, a reflective layer 12, and a light emitting layer 13. The reflective layer 12 is provided between the substrate 11 and the light emitting layer 13. Specifically, the reflective layer 12 is formed on the substrate 11, and the light emitting layer 13 is formed on the reflective layer 12.

The substrate 11 supports layers formed on the substrate 11. The material and shape of the substrate 11 are selected to support the layers formed on the substrate 11. Specifically, glass substrates, quartz substrates, ceramic substrates, etc. can be used as the substrate 11.

The light emitting layer 13 is formed on the reflective layer 12. The light emitting layer 13 emits light. As the material of the light emitting layer 13, phosphor materials that emit light when irradiated with ultraviolet light and semiconductor materials that emit light when applied with an electric field can be used, for example.

The reflective layer 12 is formed on the substrate 11. The reflective layer 12 reflects the light emitted by the light emitting layer 13. The reflective layer 12 is formed by disposing plate-like inorganic oxide particles (hereinafter may be referred to as plate-like particles 20) on the substrate 11. The plate-like particles 20 are described later. The reflective layer 12 can be formed by, for example, a screen printing method, an ink-jet method, etc. The thickness of the reflective layer 12 preferably is at least 1 μm and not more than 100 μm. Moreover, the thickness of the reflective layer 12 more preferably is at least 5 μm and not more than 20 μm. When the thickness of the reflective layer 12 is less than 1 μm, the reflective layer 12 cannot reflect light sufficiently in some cases. Because the reflectance of the reflective layer 12 is saturated when the thickness thereof is more than 100 μm, the thickness thereof need not be more than 100 μm to serve as a reflective layer.

Each the plate-like particles 20 has a shape with an aspect ratio of at least 3. The term "aspect ratio" means a value obtained by dividing the longest diameter of the largest face of the inorganic oxide particle by the thickness thereof. Hereinafter in this specification, the term "plate-like inorganic oxide particle" is used in the same meaning. Examples of shapes of the plate-like particles 20 include, for example, a shape obtained by pressing a sphere in one direction (an oblate spherical shape) as well as a flake shape and a plate-like shape whose largest face is flat. Among these shapes, the shape whose largest face is flat is preferred because it can provide a reflective layer with higher reflectance.

Figure 2A:
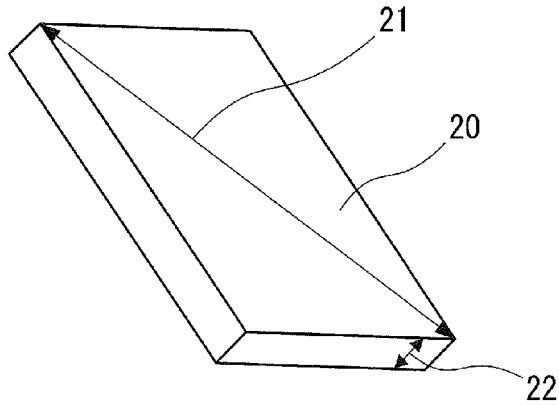
FIG. 2A is an illustrative view showing an example of shapes of plate-like particles in the light emitting device of Embodiment 1 according to the present invention.
Figure 2B:
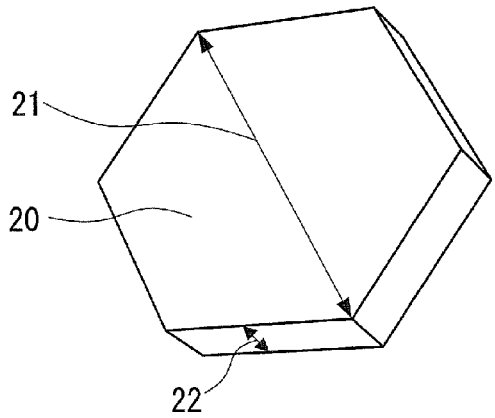
FIG. 2B is an illustrative view showing another example of shapes of the plate-like particles in the light emitting device of Embodiment 1 according to the present invention.

FIG. 2A and FIG. 2B are illustrative views each showing a particle shape whose largest face is flat as an example of particle shapes of the plate-like particles 20 that constitute the reflective layer 12. Here, the largest width of the largest face of the plate-like particle 20 is referred to as "long-axis diameter (longest diameter) 21", and the length of the plate-like particle 20 in the direction perpendicular to the largest face is referred to as "thickness 22 of the plate-like particle (thickness)." The thickness 22 of the plate-like particle is smaller than the long-axis diameter 21. The aspect ratio obtained by dividing the long-axis diameter 21 by the thickness 22 of the plate-like particle 20 (hereinafter may be simply referred to as "aspect ratio") is at least 3, and preferably is more than 10 and not more than 100.

The long-axis diameter 21 of each of the plate-like particles 20 preferably is in the range of 0.1 μm to 10 μm. The shapes in FIG. 2A and FIG. 2B are shown by way of example. The shape of the flat face is not limited to these shapes and may be any other shape, such as round shapes, elliptical shapes, and polygonal shapes. When the reflective layer 12 is formed in a minute region (e.g., when the light emitting device 10 of this embodiment is used in a PDP), the thickness 22 of each of the plate-like particles 20 preferably is in the range of, for example, 0.1 μm to 10 μm.

The plate-like particles 20 preferably are formed of a material containing at least one selected from the group consisting of aluminum oxide (alumina ($Al_2O_3$)), titanium oxide (titania ($TiO_2$)), barium titanate ($BaTiO_3$), zirconium oxide (zirconia ($ZrO_2$)), magnesium oxide (magnesia (MgO)), zinc oxide (ZnO), and barium sulfate ($BaSO_4$). These are examples of inorganic oxides. Moreover, these are examples of materials that reflect light. Among these materials, alumina is particularly preferred. Alumina has a relatively high reflectance to light in a short wavelength region (ultraviolet region). Accordingly, when the reflective layer 12 of this embodiment is used in PDPs that use ultraviolet light for luminescence, the plate-like particles 20 formed of alumina can provide the PDPs with higher brightness.

It is preferred that the plate-like particles 20 of Embodiment 1 be accumulated in such a way that the largest flat face of each of the particles be oriented substantially parallel to the principal plane of the substrate 11 as shown in FIG. 1. In order to realize such an orientation of the plate-like particles 20, the present inventors have made studies and experiments, and revealed that the orientation can be achieved with commonly-used coating methods, such as a screen printing method, a method using a dispenser, and an ink-jet method.

The light emitting device 10 of Embodiment 1 has a feature that the reflective layer 12 includes the plate-like particles 20. Hereinafter, characteristic features of this embodiment are described in details. In order to facilitate the description, the upward direction from the light emitting layer 13 is referred to as "forward direction", and the opposite direction thereof is referred to as "backward direction."

Part of light emitted from the light emitting layer 13 is emitted in the backward direction. In Embodiment 1, the plate-like particles 20 are used in the reflective layer 12. The reflectance of the reflective layer 12 is therefore high compared to conventional reflective layers in which spherical particles are used. One possible reason for the high reflectance is that light entering the space between the plate-like particles is reflected by other plate-like particles and thus tends to move in the forward direction. Accordingly, it is believed that the probability that light emitted in the backward direction from the light emitting layer 13 will pass through the space between the plate-like particles 20 to reach the substrate 11 is low in the light emitting device 10 of this embodiment. The reflective layer 12 therefore allows the light emitted in the backward direction to be reflected efficiently in the forward direction.

Moreover, it is preferred that the plate-like particles 20 be accumulated on the substrate 11 in such a way that the largest face of each of the particles be oriented substantially parallel to the principal plane of the substrate 11. In this arrangement, the largest face of each of the plate-like particles 20 faces the light emitting layer. Accordingly, the light emitted in the backward direction can be reflected in the forward direction more reliably. The reflective layer 12 therefore allows the light emitted in the backward direction to be reflected more efficiently in the forward direction.

Moreover, the aspect ratio of each of the plate-like particles 20 may be more than 10 and not more than 100. Such particles make it easier to realize the above-mentioned arrangement in which the plate-like particles 20 are accumulated in such a way that the largest face of each of the particles is oriented substantially parallel to the principal plane of the substrate 11.

The light emitting device of Embodiment 1 may be used in display devices, such as plasma display devices, electroluminescent devices, etc.

EXAMPLES

Examples of Reflective Layers

Figure 3:
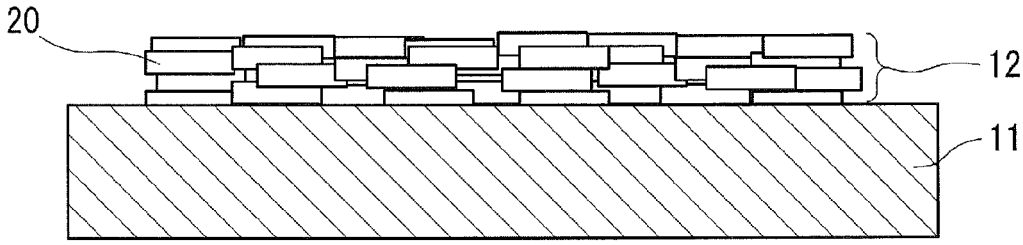
FIG. 3 is a schematic cross-sectional view showing a reflective layer, which is formed of the plate-like particles, in the light emitting device of Embodiment 1 according to the present invention.
Figure 4:
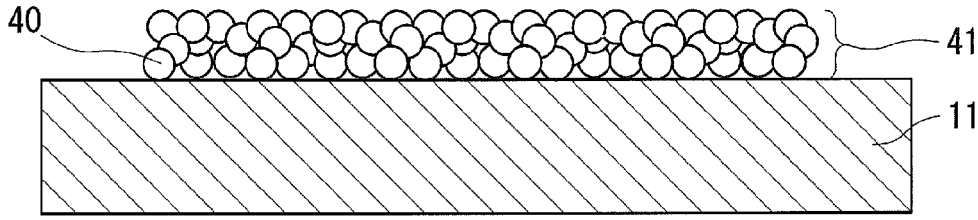
FIG. 4 is a schematic cross-sectional view showing a conventional reflective layer formed of spherical particles.

The reflective layers 12 formed of the plate-like particles 20 and conventional reflective layers formed of spherical particles were formed as examples of reflective layers, and the reflectance thereof were compared to one another. FIG. 3 is a schematic cross-sectional view showing the reflective layer 12 that was formed of the plate-like particles 20 as Examples 1 to 3 according to the present invention. FIG. 4 is a schematic cross-sectional view showing a conventional reflective layer 41 that was formed of spherical particles 40 as Comparative Examples 1 to 3.

Hereinafter, Examples 1 to 3 and Comparative Examples 1 to 3 are described in detail. It should be noted that the present invention is not limited to the following examples. Alumina particles used in the following Examples and Comparative Examples were selected from commercially available alumina particles to have the following properties and shapes.

In Example 1, the reflective layer 12 was formed by applying the plate-like particles 20 on a glass substrate (i.e., the substrate 11) using a screen printing method. The reflective layer 12 was formed of the plate-like alumina particles. The thickness of the reflective layer 12 was controlled with repeated coating using a screen printing method. The screen printing method used in this example could form a film having a thickness of 5 μm with a single coating, and thus the reflective layer 12 can have a desired thickness according to the number of coatings.

In Example 1, plate-like alumina particles that have an average particle diameter (long-axis diameter) of 2 μm, an average plate thickness (thickness of the plate-like particle) of 0.04 μm, and an aspect ratio of about 50 were used. The thickness of the reflective layer 12 was 5 μm. A SEM image of a cross section of the reflective layer 12 showed that the plate-like alumina particles were accumulated in such a way that the flat face of each of the particles was oriented substantially parallel to the glass substrate.

Next, the reflective layer 12 having a thickness of 10 μm was formed as Example 2. The reflective layer 12 was formed using the same material and method as Example 1 except for the thickness.

Figure 14:
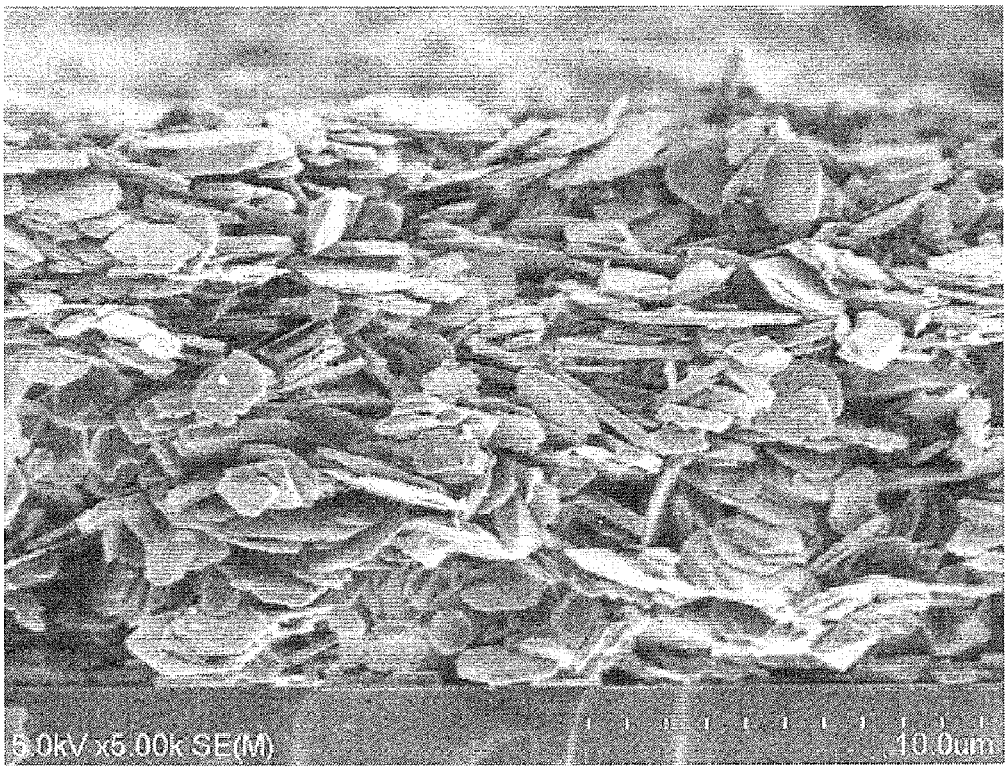
FIG. 14 is a scanning electron microscope (SEM) image showing a cross section of a reflective layer of Example 3.

Next, the reflective layer 12 having a thickness of 15 μm was formed as Example 3. The reflective layer 12 was formed using the same material and method as Example 1 except for the thickness. A cross section obtained by cutting the reflective layer 12 along the thickness direction was observed using SEM. FIG. 14 is a SEM image showing the cross section of the reflective layer 12 of Example 3. The alumina particles near the cut surface collapsed when the reflective layer 12 was cut. Because of this, the cross section of the reflective layer 12 shown in FIG. 14 does not properly show the orientation of the alumina particles. However, part of an inside portion spaced apart from the cross section was shown in the image, demonstrating that the flat faces of the alumina particles were parallel to the principal plane of the substrate. That is, the alumina particles that constitute the reflective layer 12 of Example 3 were considered to be in a state where the largest flat face of each of the particles was oriented substantially parallel to the principal plane of the substrate 11.

Next, the reflective layer 41 formed of spherical alumina particles having an average particle diameter of 0.5 μm was formed as Comparative Example 1. The thickness of the reflective layer 41 of Comparative Example 1 was 5 μm. The reflective layer 41 was formed using the same material and method as Example 1 except that the spherical alumina particles were used.

Next, the reflective layer 41 having a thickness of 10 μm was formed as Comparative Example 2. The reflective layer 41 was formed using the same material and method as Comparative Example 1 except for the thickness.

Next, the reflective layer 41 having a thickness of 15 μm was formed as Comparative Example 3. The reflective layer 41 was formed using the same material and method as Comparative Example 1 except for the thickness.

The reflectance of the reflective layers thus formed was measured using a spectrophotometer made by SHIMADZU CORPORATION. Barium sulfate was used as a reference material in the spectrophotometer. That is, the reflectance was measured using the reflectance of barium sulfate as a reference (i.e., 100%).

Figure 5:
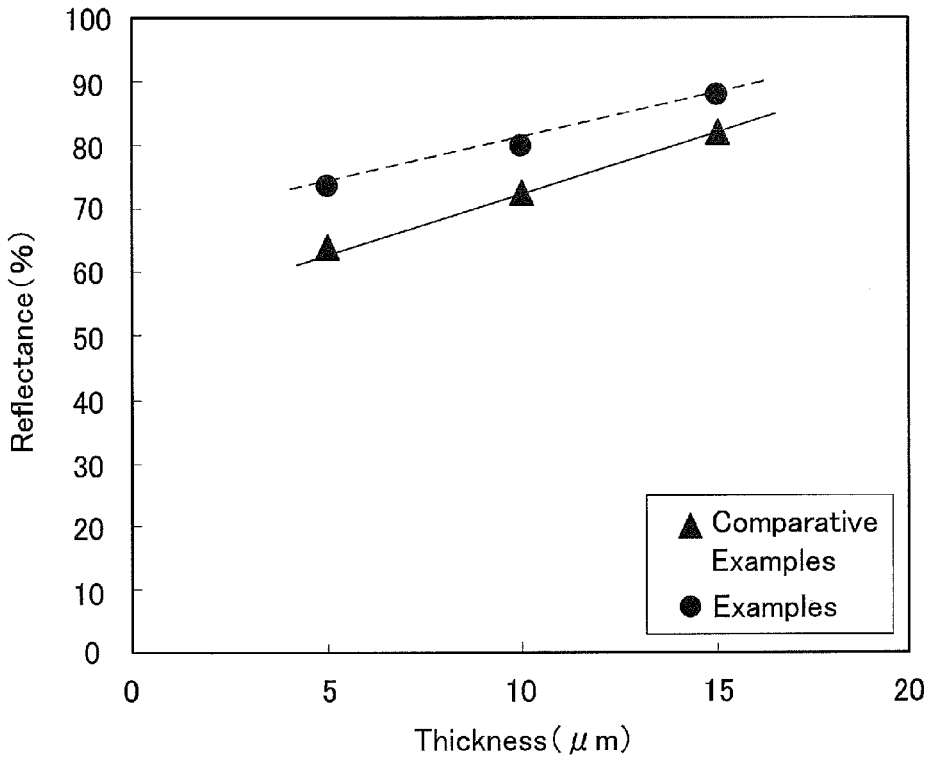
FIG. 5 is a graph showing reflectance of Examples 1 to 3 and Comparative Examples 1 to 3.

FIG. 5 is a graph plotting the reflectance obtained by irradiating the reflective layers of Examples 1 to 3 and Comparative Examples 1 to 3 with light of a wavelength of 550 nm. The vertical axis represents the reflectance (%), while the horizontal axis represents the thickness (μm) of the reflective layer. The reflectance of the reflective layers including the plate-like alumina particles ("Examples" in the graph in FIG. 5) was about 10% higher than that of the reflective layers including the spherical alumina particles ("Comparative Examples" in the graph in FIG. 5).

Examples of Light Emitting Devices

As examples of light emitting devices, a light emitting layer having a thickness of 5 μm was formed on both the reflective layer 12 (shown in FIG. 3) formed of the plate-like particles 20 and the conventional reflective layer 41 (shown in FIG. 4) formed of the spherical particles 40. Then, the brightness of the light emitting devices was compared to one another. As the phosphor material used to form the light emitting layer, $(Y, Gd)BO_3$:Eu was used.

Examples 4 to 6 and Comparative Examples 4 to 6 are described in detail below. It should be noted that the present invention is not limited to the following examples.

Examples 4 to 6 were produced by forming light emitting layers having a thickness of 5 μm with a screen printing method on the reflective layers 12 formed in Examples 1 to 3.

Comparative Examples 4 to 6 were produced by forming light emitting layers having a thickness of 5 μm with a screen printing method on the reflective layers 41 formed in Comparative Examples 1 to 3.

Moreover, a light emitting device in which only a light emitting layer was formed on a glass substrate was produced as Comparative Example 7.

Then, the brightness of the light emitting devices of Examples 4 to 6 and Comparative Examples 4 to 7 was measured using a vacuum-ultraviolet photoluminescence measurement equipment (the product name "Photoluminescene measurement System" made by OTSUKA ELECTRONICS Co., Ltd.).

Figure 6:
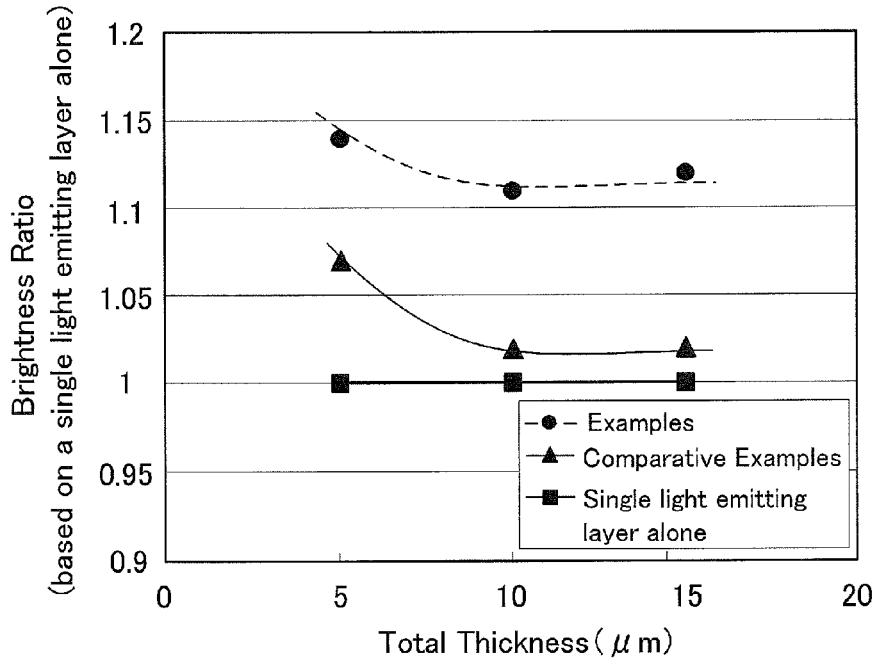
FIG. 6 is a graph showing brightness of Examples 4 to 6 and Comparative Examples 4 to 7.

FIG. 6 is a graph plotting the brightness of Examples 4 to 6 and the brightness of Comparative Examples 4 to 7. The vertical axis represents the brightness of the light emitting device, while the horizontal axis represents the sum of the thickness of the reflective layer and the thickness of the light emitting layer. The brightness of the light emitting devices was calculated using the brightness of Comparative Example 7 as the reference value "1." That is, the brightness of Examples 4 to 6 (Brightness of "Examples" in the graph in FIG. 6) and the brightness of Comparative Examples 4 to 6 (Brightness of "Comparative Examples" in the graph in FIG. 6) are values relative to the reference brightness, which is the brightness of Comparative Example 7 having no layers other than the light emitting layer.

The brightness of Example 4 was 1.14. The brightness of Example 5 was 1.11. The brightness of Example 6 was 1.12. The brightness of Comparative Example 4 was 1.07. The brightness of Comparative Example 5 was 1.02. The brightness of Comparative Example 6 was 1.02. These results demonstrated that the reflective layer including the plate-like particles increases the brightness of the light emitting device. Moreover, these results demonstrated that the reflective layer including the plate-like particles can achieve higher brightness independently of the thickness thereof than the reflective layer including the spherical particles.

Embodiment 2

Hereinafter, a PDP of Embodiment 2 is described with reference to the drawings. In Embodiment 2, the light emitting device of Embodiment 1 is used in a PDP.

<Structure of the PDP>

Figure 7:
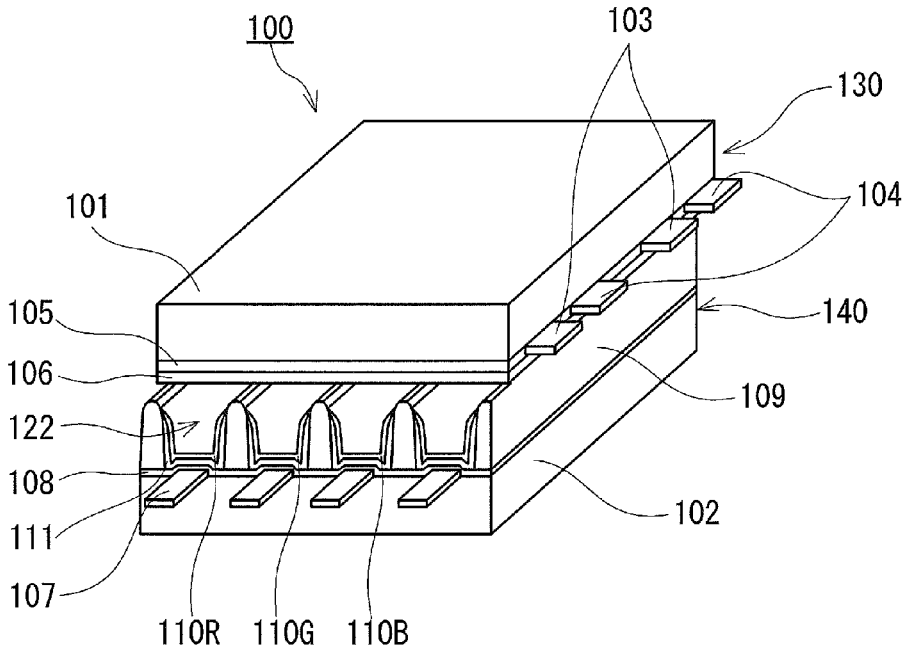
FIG. 7 is a partial cross-sectional perspective view showing a PDP of Embodiment 2 according to the present invention.
Figure 8:
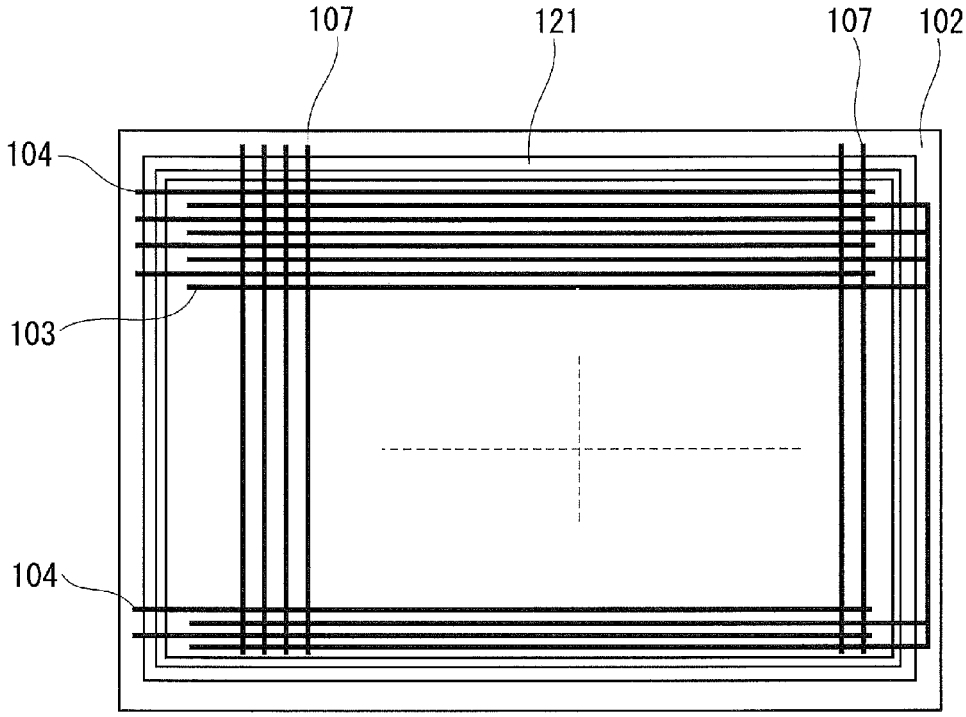
FIG. 8 is a plan view schematically showing an electrode arrangement in the PDP of Embodiment 2 according to the present invention.

FIG. 7 is a partial cross-sectional perspective view showing a schematic configuration of a PDP 100 of Embodiment 2. In FIG. 7, hatching is omitted for ease of understanding. FIG. 8 shows an electrode arrangement of the PDP 100 of Embodiment 2 when viewed from the front side. However, in FIG. 8, a base dielectric glass layer 108, barrier ribs 109, a phosphor layer 110 and a reflective layer 111 of a back panel 140, and a front glass substrate 101, a dielectric glass layer 105 and a MgO protective layer 106 of a front panel 130 are not shown in order to clearly show the electrode matrix structure composed of sustaining electrodes 103, scanning electrodes 104, and address electrodes 107.

The PDP 100 is composed of the front panel 130 and the back panel 140.

<Description of the Front Panel>

The front panel 130 includes the front glass substrate 101, the sustaining electrodes 103, the scanning electrodes 104, the dielectric glass layer 105, and the MgO protective layer 106.

The term "front" means the audience side (the audience watching pictures provided by the PDP 100), and the term "back" means the opposite side of the "front" side.

The front glass substrate 101 is a transparent substrate that transmits visible light. The front glass substrate 101 is formed of a glass material, such as sodium borosilicate glasses. The front glass substrate 101 is produced using a float process, etc.

The N sustaining electrodes 103 and the N scanning electrodes 104 (where N is an integer of 2 or more) are arranged in pairs and parallel to one another. In Embodiment 2, the N sustaining electrodes 103 and the N scanning electrodes 104 are alternately arranged in the order as "the sustaining electrode 103—the scanning electrode 104—the sustaining electrode 103—the scanning electrode 104— . . . ."

The sustaining electrodes 103 and the scanning electrodes 104 supply discharge spaces 122 with electric power required for discharge. The sustaining electrodes 103 and the scanning electrodes 104 may be transparent electrodes so that light emitted from the phosphor layer 110 (110R, 110G, 110B) formed in the back panel 140 described below will not be blocked. Moreover, the sustaining electrodes 103 and the scanning electrodes 104 may include a bus electrode (not shown) in order to reduce the electric resistance. The material of the bus electrode preferably is a low resistance metal.

The dielectric glass layer 105 is formed so as to cover the sustaining electrodes 103 and the scanning electrodes 104. The dielectric glass layer 105 serves as a capacitor, and has a memory function of storing electric charges generated by discharge. The dielectric glass layer 105 preferably withstands high voltage in order to prevent a dielectric breakdown caused due to high voltage. Moreover, it is preferred that the dielectric glass layer 105 be highly transparent to visible light in order to avoid blocking light generated by discharge. As a material used to form the dielectric glass layer 105, a mixture of low-melting-glass powder and an organic solvent or a resin can be used.

The MgO protective layer 106 is formed in the top surface, which faces the back panel 102, of the front panel 101 so as to cover the dielectric glass layer 105. The MgO protective layer 106 has impact resistance, electron emission properties, and a memory function. Because the MgO protective layer 106 has impact resistance, it can protect the dielectric glass layer 105 from the impact caused due to discharge. Moreover, because the MgO protective layer 106 has electron emission properties, it allows secondary electrons to be emitted and thereby makes discharge easier to maintain. Moreover, because the MgO protective layer 106 has a memory function, it can store electric charges. The MgO protective layer 106 is formed as a thin film using sputtering methods or electron beam evaporation methods in most cases.

<Description of the Back Panel>

The back panel 140 includes a back glass substrate 102, the address electrodes 107, the base dielectric glass layer 108, the barrier ribs 109, the phosphor layers 110R, 110G, and 110B, and the reflective layer 111.

The back glass substrate 102 is disposed to face the front glass substrate 101, being a certain distance away from the front glass substrate 101. A plurality of discharge spaces 122 are formed by dividing the space between the front glass substrate 101 and the back glass substrate 102 by the barrier ribs 109. The back glass substrate 102 is formed of a glass material as well as the front glass substrate 101, but need not be transparent.

The address electrodes 107 are electrodes for generating address discharge that makes it easier to generate sustaining discharge between the sustaining electrodes 103 and the scanning electrodes 104. Specifically, the address electrodes 107 have a function of lowering the voltage required to generate the sustaining discharge. The address discharge occurs between the scanning electrodes 104 and the address electrodes 107.

The address electrodes 107 are formed on the front side of the back glass substrate 102. The M address electrodes 107 (where M is an integer of 2 or more) are arranged parallel to one another. When the front glass substrate 101 and the back glass substrate 102 are bonded together, the address electrodes 107 are arranged perpendicular to the sustaining electrodes 103 and the scanning electrodes 104. Such an arrangement provides an electrode matrix structure (see FIG. 8) composed of three kinds of electrodes, i.e., the sustaining electrodes 103, the scanning electrodes 104, and the address electrodes 107.

A low-resistance metallic material preferably is used as the material of the address electrodes 107. In particular, silver is preferred.

The base dielectric glass layer 108 is formed so as to cover the address electrodes 107. The base dielectric glass layer 108 has a function of controlling electric current in the address electrodes 107 and a function of preventing a dielectric breakdown. The same material as the dielectric glass layer 105 in the front panel 101 can be used to form the base dielectric glass layer 108.

The barrier ribs 109 are formed on the front side of the base dielectric glass layer 108. The barrier ribs 109 divide the space between the front panel 130 and the back panel 140, thereby forming a plurality of discharge spaces 122. A mixed gas, such as Ne—Xe, is sealed in the discharge spaces 122 as a discharge gas.

The barrier ribs 109 can be formed by a sandblasting method, a printing method, a photo etching method, etc. A material containing a low-melting glass, an aggregate, etc. can be used to form the barrier ribs 109.

The barrier ribs 109 are formed in such a way that they have a lattice pattern when viewed from the front side of the PDP 100. However, the shape of the barrier ribs 109 is not limited to a lattice pattern as long as it can form a plurality of discharge spaces 122. For example, the shape of the barrier ribs 109 may be a stripe shape or a regularly winding meander shape. Moreover, the shape of the discharge space 122 is not limited to a rectangle. For example, the shape of the discharge space 122 may be a polygonal shape (e.g., a triangle and a pentagon), a round shape, or an elliptical shape. That is, they are not limited as long as a plurality of concave portions are formed on the front side of the back panel 140. In the PDP 100 of this embodiment, the back glass substrate 102, the base dielectric glass layer 108 and the barrier ribs 109 correspond to the substrate of the PDP according to the present invention, and the concave portions formed by the base dielectric glass layer 108 and the barrier ribs 109 correspond to the concave portions formed in the principal plane of the substrate of the PDP according to the present invention.

The phosphor layer 110 consists of the red phosphor layer 110R, the green phosphor layer 110G, and the blue phosphor layer 110B that emit red light, green light, and blue light respectively, which are the three primary colors.

As the phosphor layer 110, red phosphor particles, green phosphor particles, and blue phosphor particles are accumulated to have a predetermined thickness inside the concave portions formed by the barrier ribs 109 and the base dielectric glass layer 108. Any phosphor particles can be used as long as they have a function of emitting visible light when irradiated with ultraviolet light, and phosphor materials known in the art can be used. $(Y, Gd)BO_3:Eu^{3+}$, $Y_2O_3:Eu^{3+}$, etc. can be used to form the red phosphor layer 110R. $Zn_2SiO_4:Mn^{2+}$, etc. can be used to form the green phosphor layer 110G. $BaMgAl_{10}O_{17}:Eu^{2+}$, etc. can be used to form the blue phosphor layer 110B.

Figure 9:
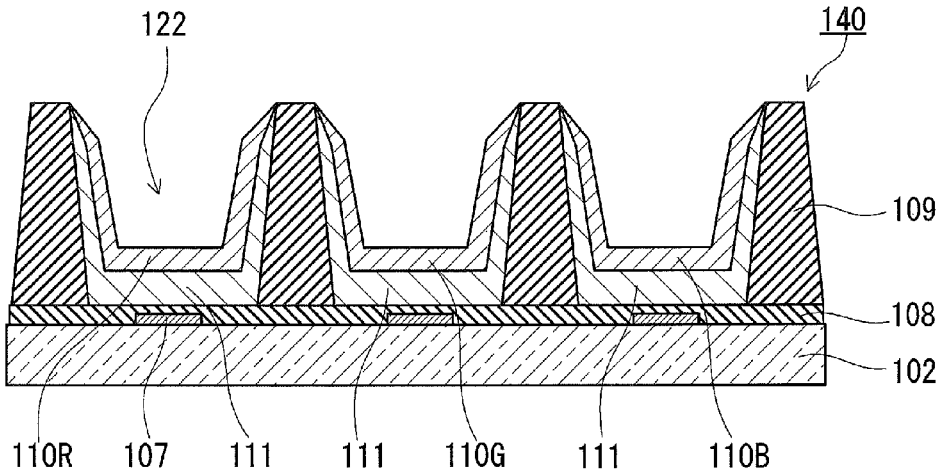
FIG. 9 is a partial cross-sectional view showing a back panel of the PDP of Embodiment 2 according to the present invention.

FIG. 9 is a cross-sectional schematic view showing the back panel 140. Hereinafter, the reflective layer 111 is described with reference to FIG. 10. Since the plate-like particles 20 that constitute the reflective layer 111 are the same as that used in Embodiment 1, the description thereof is omitted here.

The reflective layer 111 is provided between the phosphor layer 110 and the inner surfaces of the concave portions that are formed on the front side of the back panel 140 and that are formed by the barrier ribs 109 and the base dielectric glass layer 108. Specifically, the reflective layer 111 is formed on the front side surface of the base dielectric glass layer 108 and on the side surfaces of the barrier ribs 109.

The reflective layer 111 includes the plate-like particles 20. The largest face of each of the plate-like particles 20 is flat in this embodiment.

Ultraviolet light generated by discharge is absorbed in a very shallow surface region (surface to about 0.1 μm depth) of the phosphor layer 110 to excite the phosphors, and thereby the phosphors emit light. The light is not necessarily emitted in a forward direction, and part of the light is emitted in a backward direction. Here, "surface of the phosphor layer" means the surface that is exposed to the discharge space 122 among surfaces of the phosphor layer 110. The term "forward direction" means the direction from the phosphor layer 110 to the discharge space 122. The term "backward direction" means the direction from the phosphor layer 110 to the barrier ribs 109 and the base dielectric glass layer 108. In other words, the term "backward direction" can also be referred to as the direction from the phosphor layer 110 to the concave portions formed by the barrier ribs 109 and the base dielectric glass layer 108.

The reflective layer 111 allows the light emitted from the phosphor layer 110 in the backward direction of the phosphor layer 110 to be reflected in the forward direction.

Features of Embodiment 2

The PDP 100 of Embodiment 2 differs from conventional PDPs in that the reflective layer 111 includes the plate-like particles 20. Because the reflective layer 111 of Embodiment 2 includes the plate-like particles 20, it can achieve a high reflectance compared to conventional reflective layers containing spherical particles. One possible reason for the high reflectance is that light entering the space between the plate-like particles is reflected by other plate-like particles and thus tends to move in the forward direction. Accordingly, it is believed that the probability that light emitted in the backward direction will pass through the space between the plate-like particles 20 to reach the barrier ribs 109 or the base dielectric glass layer 108 is low. The reflective layer 111 therefore allows the light emitted in the backward direction to be reflected efficiently in the forward direction. This effect can be achieved more effectively when the largest face of each of the plate-like particles 20 is flat.

Figure 10:
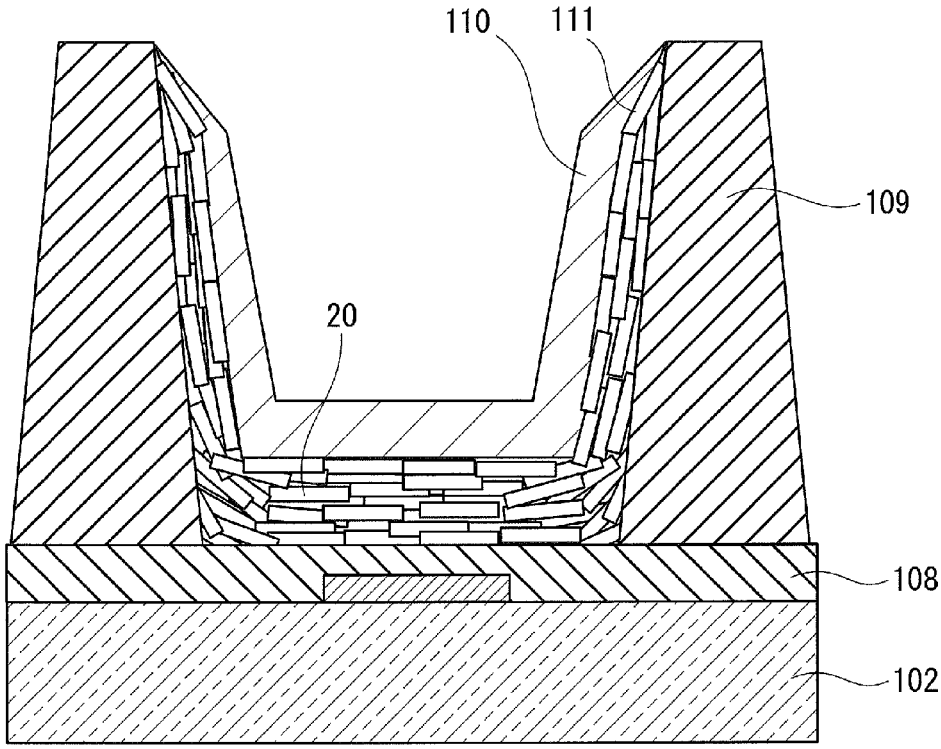
FIG. 10 is an illustrative view showing an arrangement of plate-like particles in a reflective layer of the PDP of Embodiment 2 according to the present invention.

FIG. 10 is a schematic sectional view showing the reflective layer 111. As shown in FIG. 10, the plate-like particles 20 may be accumulated in the thickness direction of the reflective layer 111 in such a way that the largest face of each of the plate-like particles 20 is oriented substantially parallel to the inner wall surfaces of the concave portions that is formed by the barrier ribs 109 and the base dielectric glass layer 108. Such an arrangement allows the largest face of each of the plate-like particles 20 to face the phosphor layer 110. Accordingly, light emitted in the backward direction can be reflected in the forward direction more reliably. The reflective layer 111 therefore allows the light emitted in the backward direction to be reflected more efficiently in the forward direction. This effect can be achieved more effectively in embodiments such as this embodiment where the largest face of each of the plate-like particles 20 is flat face as shown in FIG. 10. In order to realize such an arrangement, the present inventors have made studies and experiments, and revealed that the structure can be achieved with commonly-used coating methods, such as a screen printing method, a method using a dispenser, and an ink-jet method, using commonly-used phosphor inks or phosphor pastes.

Moreover, the aspect ratio of each of the plate-like particles 10 that constitute the reflective layer 111 may be more than 10 and not more than 100. Such particles make it easier to realize the above-mentioned arrangement where the largest face of each of the plate-like particles 20 faces the phosphor layer.

The thickness of the reflective layer 111 preferably is at least 1 μm and not more than 50 μm. The thickness of the reflective layer 111 more preferably is at least 5 μm and not more than 20 μm. When the thickness of the reflective layer 111 is less than 1 μm, the reflective layer 12 cannot reflect light sufficiently in some cases. On the other hand, when the thickness of the reflective layer 111 is more than 50 μm, the reflective layer 111 makes the discharge space 122 small and discharge characteristics deteriorate in some cases.

<Method of Producing the PDP>

Next, a method of producing the PDP 100 is described with reference to FIG. 7 and FIG. 8.

First, a method of producing the front panel 130 is described. The N sustaining electrodes 103 and the N scanning electrodes 104 are formed into stripes on the front glass substrate 101. Next, the sustaining electrodes 103 and the scanning electrodes 104 are coated with the dielectric glass layer 105. Next, the MgO protective layer 106 is formed on the dielectric glass layer 105.

The sustaining electrodes 103 and the scanning electrodes 104 are formed by applying a silver paste (silver based paste which is used to form electrodes) with a screen printing method and baking the paste. The dielectric glass layer 105 is formed by applying a paste containing a bismuth oxide-based glass with a screen printing method and baking the paste. The paste containing the bismuth oxide-based glass can be prepared by mixing an organic binder (for example, 10% ethyl cellulose dissolved in α-terpineol) and a glass material composed of 30 wt % of bismuth oxide ($Bi_2O_3$), 28 wt % of zinc oxide (ZnO), 23 wt % of boron oxide ($B_2O_3$), 2.4 wt % of silicon oxide ($SiO_2$), 2.6 wt % of aluminum oxide, 10 wt % of calcium oxide (CaO), and 4 wt % of tungsten oxide ($WO_3$). The organic binder can be obtained by dissolving resins in organic solvents. Other resins such as acrylic resin can be used as well as ethyl cellulose, and other organic solvents such as butyl carbitol can be used. Furthermore, a dispersant (for example, glycerol trioleate) may be added to the organic binder.

The dielectric glass layer 105 is formed to have a predetermined thickness (about 40 μm) by controlling the coating thickness. The MgO protective layer 106 is formed of magnesium oxide (MgO). The MgO protective layer 106 is formed to have a predetermined thickness (about 0.5 μm) by a sputtering method, an ion plating method etc.

Next, a method of producing the back panel 140 is described. The M address electrodes 107 is formed into stripes by applying a silver paste, which is used to form electrodes, on the back glass substrate 102 with a screen printing method and baking the paste. The base dielectric glass layer 108 is formed by applying a paste containing a bismuth oxide-based glass over the address electrodes 107 with a screen printing method and baking the paste. The barrier ribs 109 are formed by repeatedly applying a paste containing a bismuth oxide-based glass at regular intervals with a screen printing method and baking the paste. The barrier ribs 109 separate and define the discharge spaces 122. The interval between the adjacent barrier ribs 109 is set to be in the range of about 130 μm to 240 μm in accordance with 42-50 inches full HD (high definition) televisions or HD televisions.

The reflective layer 111 is formed in the grooves between the two adjacent barrier ribs 109. The reflective layer 111 is formed by, for example, a coating method such as a screen printing method and an ink-jet method. The reflective layer 111 is formed of, for example, plate-like alumina (aluminum oxide) particles each having a long-axis diameter of about 0.6 μm and a thickness of about 0.06 μm. That is, the aspect ratio obtained by dividing the longest diameter by the thickness is about 10. The material of the plate-like inorganic oxide particles is not limited to alumina and can be other materials, such as titanium oxide (titania ($TiO_2$)), barium titanate ($BaTiO_3$), zirconium oxide (zirconia ($ZrO_2$)), magnesium oxide (magnesia (MgO)), zinc oxide (ZnO), barium sulfate ($BaSO_4$), etc.

Next, the red phosphor layer 110R, the green phosphor layer 110G, and the blue phosphor layer 110B are formed on the surface of the reflective layer 111. The phosphor layers are formed by, for example, a coating method such as a screen printing method and an ink-jet method. The red phosphor layer 110R is formed of, for example, $(Y, Gd)BO_3$:Eu, which is a red phosphor material. The green phosphor layer 110G is formed of, for example, $Zn_2SiO_4$:Mn, which is a green phosphor material. The blue phosphor layer 110B is formed of $BaMgAl_{10}O_{17}$:Eu, which is a blue phosphor material.

Thus, the front panel 130 and the back panel 140 are produced and are stacked in such a way that the scanning electrodes 104 of the front panel 130 and the address electrodes 107 of the back panel 140 are arranged perpendicular to each other. Next, sealing glass is applied to the peripheral areas of the front panel 130 and the back panel 140 and is baked for 10 to 20 minutes at about 450° C. As shown in FIG. 8, the sealing glass forms an airtight seal layer 121 and seals the front panel 130 and the back panel 140 together. Next, the discharge spaces 122 are evacuated to a high vacuum and then are filled with a discharge gas (e.g., inert gas such as helium-xenon and neon-xenon) at a predetermined pressure. Thus, the PDP 100 is formed.

Embodiment 3

Figure 11:
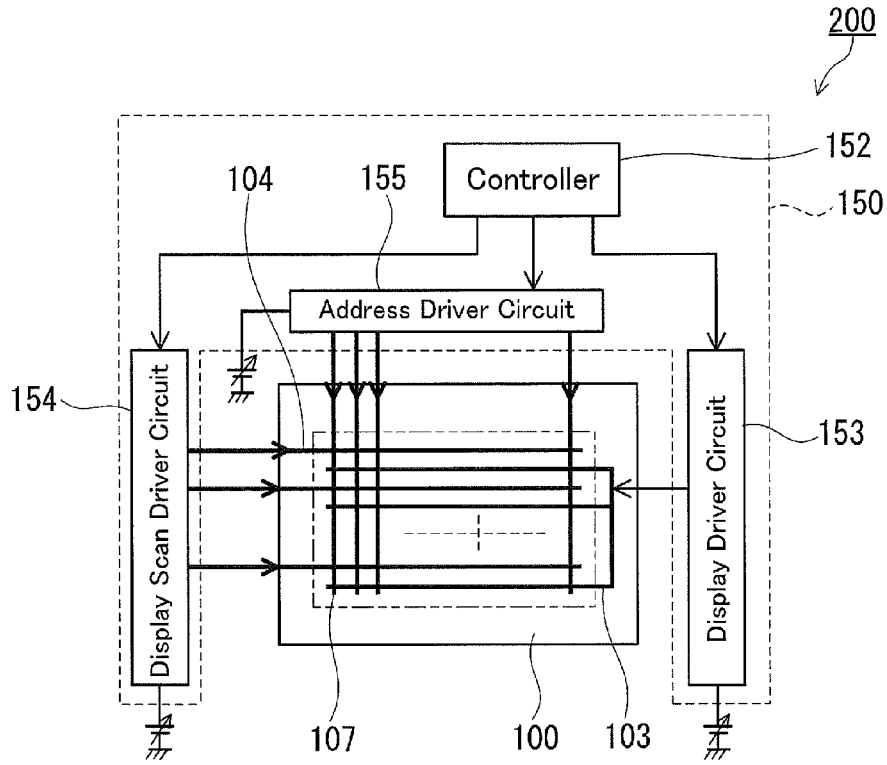
FIG. 11 is a schematic view showing a plasma display device of Embodiment 3 according to the present invention.

FIG. 11 is a schematic view showing a plasma display device 200 including the PDP 100. The PDP 100 is connected to a driving device 150 and thus constitutes the plasma display device 200. A display driver circuit 153, a display scan driver circuit 154, and an address driver circuit 155 are connected to the PDP 100. A controller 152 controls voltages applied by these circuits. Address discharge is generated by applying a predetermined voltage between the scanning electrodes 104 and the address electrodes 107 that correspond to the discharge spaces 122 (see FIG. 7) to be lit. The controller 152 controls the applied voltage. Next, a pulse voltage is applied between the sustaining electrodes 103 and the scanning electrodes 104 to generate sustaining discharge. The sustaining discharge allows the discharge cells in which the address discharge has been generated to emit ultraviolet light. The ultraviolet light excites the phosphor layer, thereby lighting the discharge cells. A combination of specific color cells that are lit and specific color cells that are not lit allows a picture to be displayed.

Other Embodiments

The present invention is not limited to the above-mentioned embodiments, and can be changed suitably. Such changes are described below by way of example.

For example, the phosphor layer may include plate-like phosphor particles. This embodiment increases the ultraviolet light absorption in the phosphor layer, and therefore it can increase brightness.

Furthermore, with reference to FIG. 7, the tops of the barrier ribs 109 may be colored black. Here, "the tops of the barrier ribs 109" means surfaces thereof that face the front panel 130. Such barrier ribs absorb external light entering through the front panel 130 and do not reflect the external light in the forward direction, and therefore the contrast of the PDP 100 can be increased.

Figure 12:
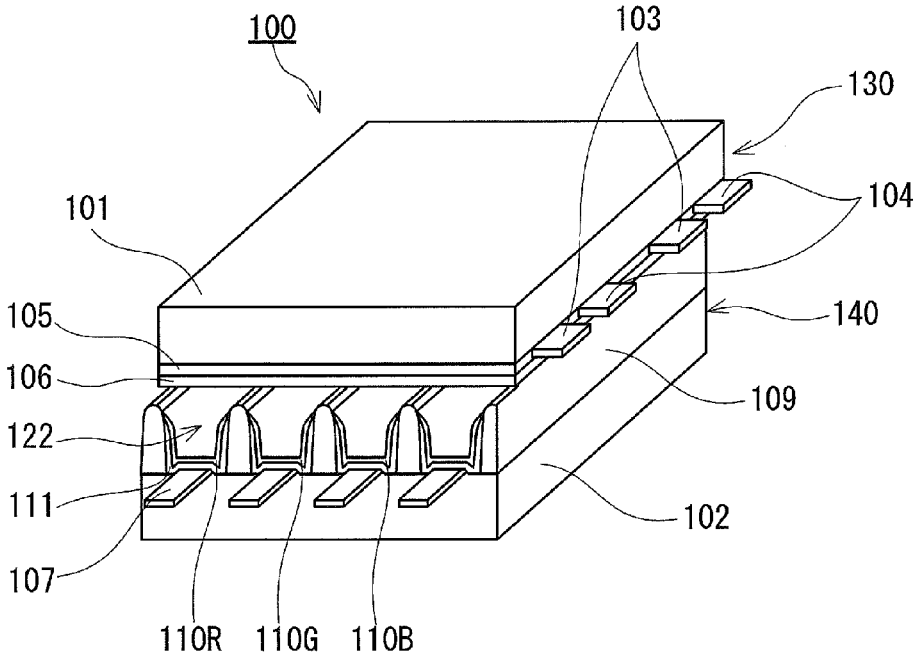
FIG. 12 is a partial cross-sectional perspective view showing a PDP of another Embodiment according to the present invention.
Figure 13:
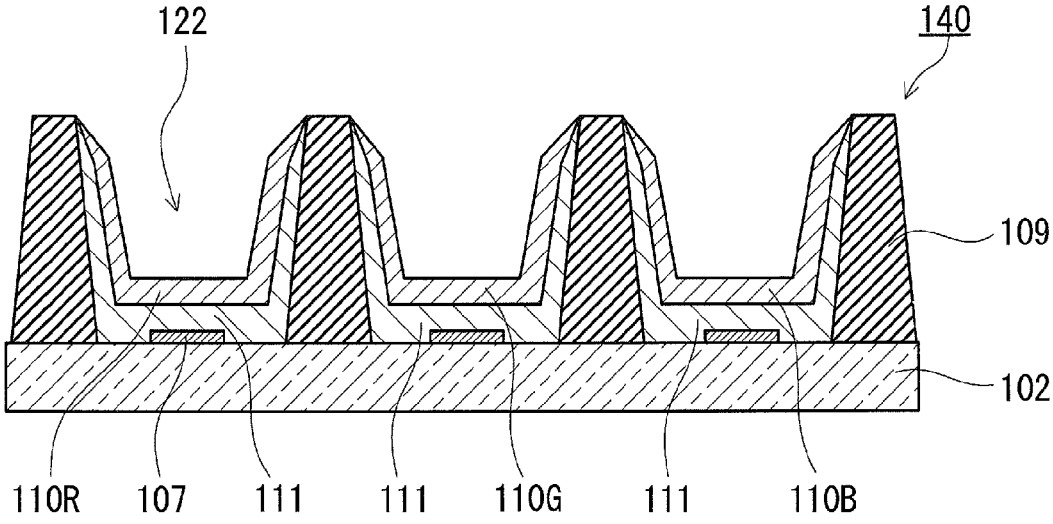
FIG. 13 is a cross-sectional view showing a back panel of a PDP of another Embodiment according to the present invention.

Although the base dielectric glass layer 108 is formed in Embodiment 2, the base dielectric glass layer 108 need not be formed. FIG. 12 is a partial cross-sectional perspective view showing a schematic configuration of a PDP in which the base dielectric glass layer 108 is not formed. In FIG. 12, hatching is omitted for ease of understanding. FIG. 13 is a cross-sectional view showing a schematic configuration of a back panel in which the base dielectric glass layer 108 is not formed. The reflective layer formed in the PDP according to the present invention can serve as a dielectric layer and therefore can realize a PDP without the base dielectric glass layer. This embodiment allows the PDP 100 to be thinner.

INDUSTRIAL APPLICABILITY

The light emitting device according to the present invention can achieve high brightness and therefore suitably is used in display devices, such as plasma display devices and electroluminescent devices.

The invention claimed is:

1. A light emitting device comprising:

a substrate;

a light emitting layer provided on the substrate; and a reflective layer provided between the substrate and the light emitting layer, wherein the reflective layer consists of plate-like inorganic oxide particles.

2. The light emitting device according to claim 1, wherein the inorganic oxide particles are accumulated on the substrate in such a way that a largest face of each of the inorganic oxide particles is oriented substantially parallel to a principal plane of the substrate.

3. The light emitting device according to claim 2, wherein the largest face of each of the inorganic oxide particles is flat.

4. The light emitting device according to claim 1, wherein an aspect ratio of each of the inorganic oxide particles is more than 10 and not more than 100, the aspect ratio being obtained by dividing a longest diameter of a largest face of the inorganic oxide particle by a thickness thereof.

5. The light emitting device according to claim 1, wherein a longest diameter of a largest face of each of the inorganic oxide particles is in a range of 0.1 μm to 10 μm.

6. The light emitting device according to claim 1, wherein a thickness of the reflective layer is at least 1 μm and not more than 100 μm.

7. The light emitting device according to claim 1, wherein the inorganic oxide particles contain at least one selected from a group consisting of $Al_2O_3$, $TiO_2$, $BaTiO_3$, $ZrO_2$, MgO, ZnO, and $BaSO_4$.

8. A plasma display panel comprising:

a substrate having a principal plane in which a plurality of concave portions are formed;

a phosphor layer provided within the concave portions; and a reflective layer provided between the phosphor layer and inner surfaces of the concave portions, wherein the reflective layer consists of plate-like inorganic oxide particles.

9. The plasma display panel according to claim 8, wherein in the reflective layer, the inorganic oxide particles are accumulated in a thickness direction of the reflective layer in such a way that a largest face of each of the inorganic oxide particles is oriented substantially parallel to inner wall surfaces of the concave portions.

10. The plasma display panel according to claim 9, wherein a largest face of each of the inorganic oxide particles is flat.

11. The plasma display panel according to claim 8, wherein an aspect ratio of each of the inorganic oxide particles is more than 10 and not more than 100, the aspect ratio being obtained by dividing a longest diameter of a largest face of the inorganic oxide particle by a thickness thereof.

12. The plasma display panel according to claim 8, wherein a longest diameter of a largest face of each of the inorganic oxide particles is in a range of 0.1 μm to 10 μm.

13. The plasma display y panel according to claim 8, wherein a thickness of the reflective layer is at least 1 μm and not more than 50 μm.

14. The plasma display panel according to claim 8, wherein the inorganic oxide particles contain at least one selected from the group consisting of alumina (aluminum oxide), titania (titanium oxide), barium titanate, zirconia (zirconium oxide), magnesia (magnesium oxide), zinc oxide, and barium sulfate.

15. A plasma display device comprising the plasma display panel according to claim 8.

* * * * *